United States Patent [19]
Vanden Driessche

[11] 4,402,429
[45] Sep. 6, 1983

[54] APPARATUS FOR DRAWING OFF CARBONATED DRINKS FROM A CONTAINER WITH INCORPORATED GAS SUPPLY

[75] Inventor: Jean R. Vanden Driessche, Brussels, Belgium

[73] Assignee: Waterlomat Société Anonyme, Brussels, Belgium

[21] Appl. No.: 966,272

[22] Filed: Dec. 4, 1978

[30] Foreign Application Priority Data

Dec. 19, 1977 [FR] France ..... 77 38317

[51] Int. Cl.[3] ..... B65D 83/14
[52] U.S. Cl. ..... 222/153; 220/324; 222/396; 222/399
[58] Field of Search ..... 239/308, 309, 373; 137/212; 222/394, 396, 397, 399, 400.7, 400.5, 153, 130, 325; 169/85, 88, 76; 217/98, 106; 220/89 A, 315, 324

[56] References Cited

U.S. PATENT DOCUMENTS

| | | | |
|---|---|---|---|
| 1,184,878 | 5/1916 | Rosenstock | 222/153 |
| 2,615,598 | 10/1952 | Watkins et al. | 222/325 |
| 3,434,632 | 3/1969 | Batrow | 222/400.5 |
| 3,650,329 | 3/1972 | Sachs | 169/85 |

*Primary Examiner*—H. Grant Skaggs
*Attorney, Agent, or Firm*—Bacon & Thomas

[57] ABSTRACT

The invention pertains to an apparatus for drawing off carbonated drinks stored in containers having an incorporated supply of gas, fitted with a valve, characterized by the fact that it mainly comprises a base-plate through which passes a drawing-off pipe fitted with control elements of the valve associated with the gas storage element of a container of the type under consideration, as well as with a locking device which permits the temporary attachment of the apparatus upon a container.

2 Claims, 5 Drawing Figures

APPARATUS FOR DRAWING OFF CARBONATED DRINKS FROM A CONTAINER WITH INCORPORATED GAS SUPPLY

BACKGROUND OF THE INVENTION

The present invention pertains to an apparatus for drawing off carbonated drinks from containers, with incorporated gas supply.

In his patent application Ser. No. 969,926 filed Dec. 15, 1978 the applicant has disclosed a novel type of container for carbonated drinks which can be turned upside down, characterized by the fact that one of its walls is provided with an opening through which a body is entered in aforesaid container, such a body comprising a bottle of carbon dioxide gas, provided with a valve, which is attached by one of its ends to the adjacent edge of aforesaid opening.

SUMMARY OF THE INVENTION

The purpose of the present invention is to supply an extremely simple and unexpensive drawing-off apparatus, intended to be used with the above-mentioned container.

This apparatus is characterized by the fact that it mainly comprises a base-plate through which passes a drawing-off pipe and which is fitted with a control device for the valve of a gas bottle in a container of the type under consideration, as well as a locking means which permits the temporary attachment of the apparatus upon aforesaid container.

Preferably, the control device shall be constructed in such a manner as to form, together with aforesaid valve of the gas bottle, an efficient pressure regulator.

Preferably also, aforesaid drawing-off pipe shall be fabricated in the shape of a simple bent tube, with constant cross-section, one part of which acting as dip-tube, while the other serves as pouring nozzle.

BRIEF DESCRIPTION OF THE DRAWINGS

For clearness' sake, the invention is described hereinafter in detail with reference to the drawings appended as an example of an embodiment according to the invention. In these drawings.

Figure 1:
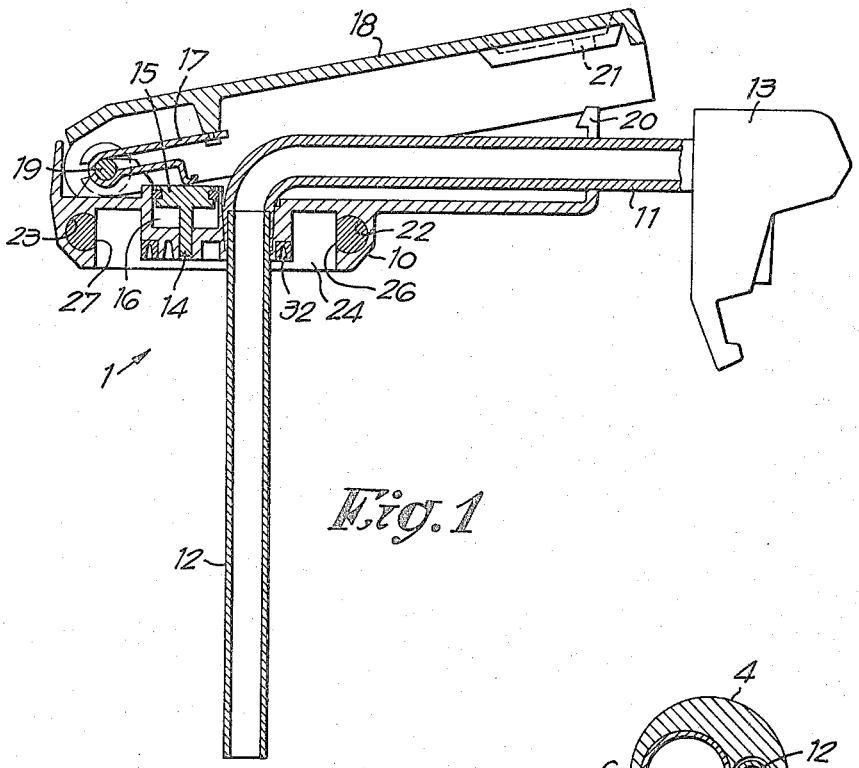
FIG. 1 shows an apparatus according to the invention in upright cross-section, the apparatus being ready to be fitted on a container of the type under consideration.
Figure 4:
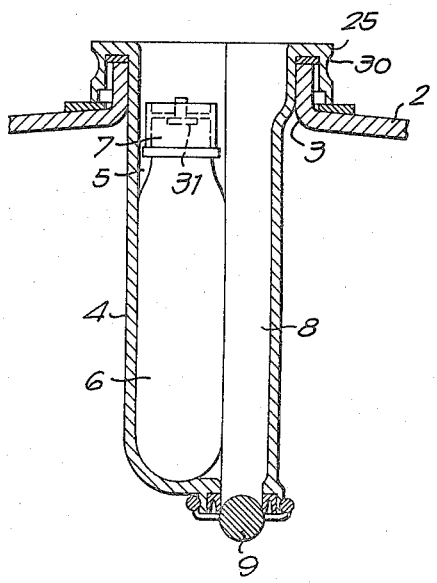
FIG. 4 is a section taken on to line IV—IV in FIG. 2.
Figure 4:
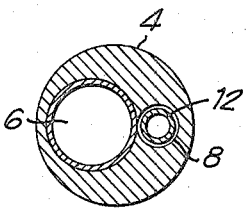

The apparatus 1 according to the invention is intended to be used with a container 2 provided with a filling opening 3 in which a body 4 is inserted which comprises a chamber 5 containing a carbon dioxide gas bottle 6 provided with a valve 7. A drawing-off pipe 8 passes straight through body 4, the lower end of aforesaid pipe being provided with a ball valve 9. As previously stated, such a container is the subject of a copending patent application in the name of the applicant.

Apparatus 1, subject of the present invention, comprises a base-plate 10, through which passes a bent drawing-off tube, one branch 11 of which forms a pouring nozzle, and the other branch a dip-tube 12. The free end of branch 11 is provided with a cock 13.

The base-plate 10 also contains a control device for aforesaid valve 7. According to an interesting particularity of the invention, this control element is built so as to form, together with aforesaid valve 7, a safety pressure regulator.

For this purpose, the control element is made up of a rod 14 fitted end-on to a piston 15 which can be moved axially in a cylindrical chamber 16 of base-plate 10.

Piston 15 is forced downward by a calibrated spring 17, as soon as the latter has been compressed.

This compression is brought about by means of a lever-lid 18 which pivots at 19 on aforesaid base-plate and can be locked in closed position by the cooperation of a catch 20, fitted to base-plate 10, and an opening 21 provided for this purpose in aforesaid lever 18.

Figure 3:
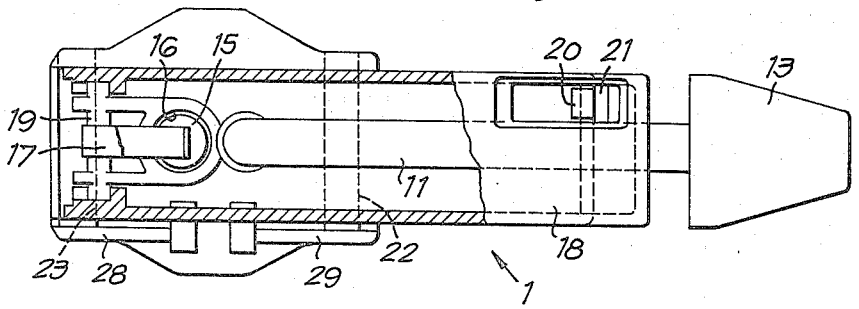
FIG. 3 is a top view of the apparatus such as shown in FIG. 2.

Base-plate 10 is further provided with a locking device which permits the temporary attachment of apparatus 1 on container 2. This means consists, in the present case, of two rods 22 and 23, which can freely pivot in bores provided in the base-plate, on either side of an annular chamber 24, the purpose of which is to receive the attachment head 25 of aforesaid body 4. Each of aforesaid rods is provided with a flat, respectively 26 and 27, and each is fitted at one of its ends with a control lever, respectively 28 and 29 (FIG. 3).

Figure 2:
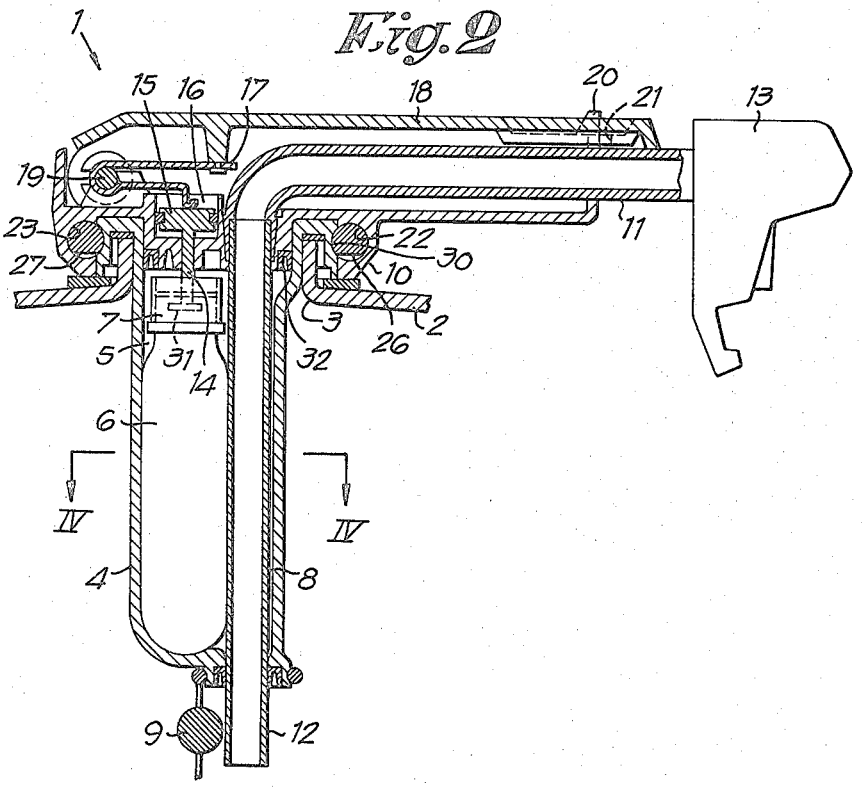
FIG. 2 shows the apparatus fitted upon the container.

For fitting the apparatus 1 on the container 2, rods 22 and 23 are brought to the position shown in FIG. 1, after which they are brought to that shown in FIG. 2 where rods 22 and 23 engage groove 30, provided for this purpose in aforesaid attachment head 25. In FIG. 3 it can be seen that the locking of lever-lid 18 when down engages and folds levers 28 and 29; in other words, it is not possible to remove apparatus 1 from container 2 without valve 7 having previously been closed.

The diameter of piston 15, that of flap 31 of valve 7, and the calibration of spring 17 are selected in such a manner as to obtain within container 2 an almost constant gas pressure, of the desired magnitude since gas pressure can enter cylinder 16.

A V-shaped seal 32, provided in aforesaid base-plate, assures the sealing between the latter and the inner wall of body 4, close to attachment head 25.

Preferably, a froth limiting device (not shown) is inserted in dip-tube 12.

Figure 5:
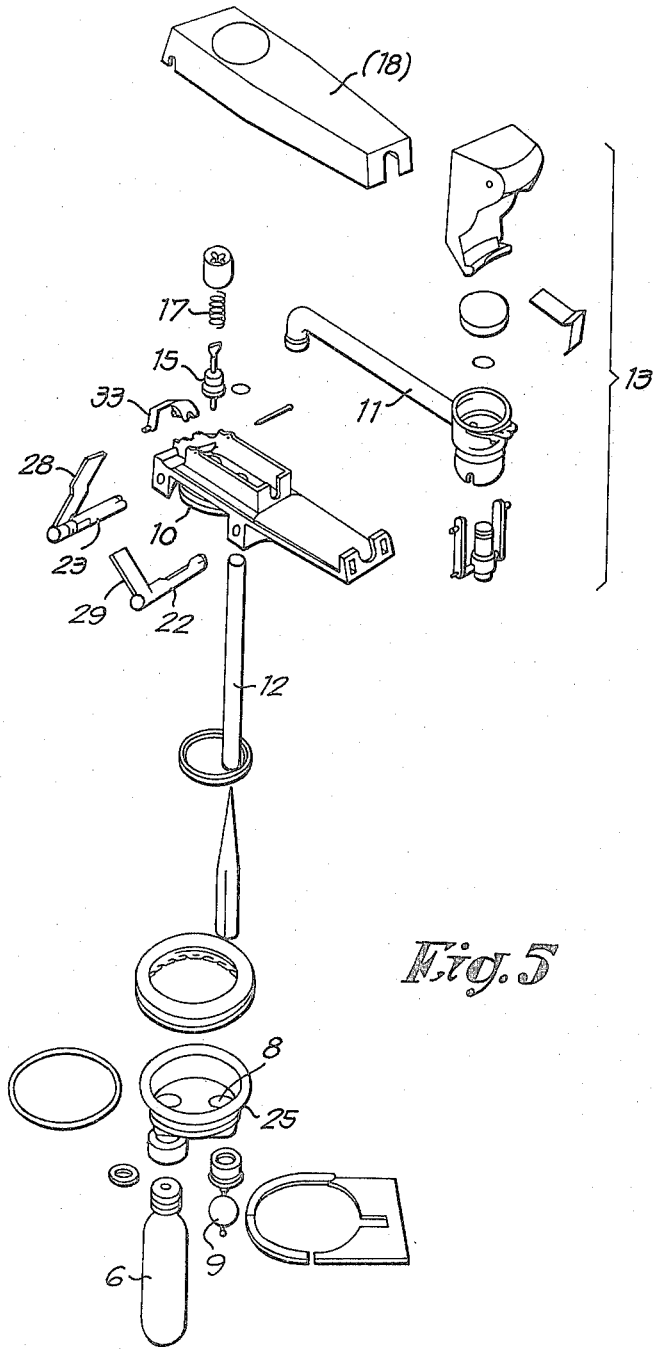
FIG. 5 shows an exploded view of an alternative embodiment of the invention.

The alternative embodiment according to FIG. 5 mainly differs from the previous example by the following items:

- the tensioning of spring 17, in this case a coil spring, is not performed by the lid 18, but by rod 23, part of which, shaped as a cam, acts upon an intermediate lever 33 which actually compresses aforesaid spring. The part of rod 23 which is shaped as a cam can only become active when the device is screwed on the container;
- there is no true chamber provided for bottle 6, the latter being screwed in a collar provided on the lower surface of attachment head 25;
- tube 8 is reduced to a mere hole in head 25, through which dip-tube 12 is intended to be fitted;
- lid 18 does not lock levers 28 and 29.

It is easy to note the extreme simplicity of the apparatus according to the invention, as well as its great degree of safety.

It is obvious that numerous alterations can be brought about to the above-described example, without going beyond the scope of the invention.

What I claim is:

1. Apparatus for drawing carbonated drinks from a container having as a part thereof, a supply of gas in a chamber fitted with a valve device;

said apparatus comprising a base plate having a drawing-off pipe and a valve actuating means, said base plate having means for securing and locking the same to said container in a position wherein said valve actuating means is adjacent and engageable with said valve device, said valve actuating means and said device together defining a gas pressure regulator;

the means for locking said base plate to said container comprising at least one rod rotatable in said base plate, said rod having a flat side, being tangent to an annular chamber on said container and having a radially extending control lever at one end and outside said base plate, a lever-lid pivoted to said base plate and being arranged to engage said control lever to rotate said rod and thereby lock said base plate to said container by projecting a non-flat portion of said rod into said annular chamber.

2. Apparatus as defined in claim 1 wherein said drawing-off pipe has a branch defining a pouring nozzle and the other of which is a dip tube.

* * * * *